United States Patent [19]

Jen-Tung

[11] 4,390,349

[45] Jun. 28, 1983

[54] METHOD FOR PRODUCING FUEL GAS FROM LIMESTONE

[75] Inventor: Cheng Jen-Tung, Taipei, Taiwan

[73] Assignee: Kuo-Yung Industrial Company, Taiwan

[21] Appl. No.: 48,815

[22] Filed: Jun. 15, 1979

[51] Int. Cl.[3] ..... C10J 3/00

[52] U.S. Cl. ..... 48/197 R; 48/202; 252/373

[58] Field of Search ..... 48/197 R, 202, 206, 48/210; 252/373; 201/38; 423/415 A, 444 A, 637

[56] References Cited

U.S. PATENT DOCUMENTS

| | | | |
|---|---|---|---|
| 2,647,045 | 7/1953 | Rummel | 48/206 |
| 3,807,090 | 4/1974 | Moss | 48/211 |
| 3,966,431 | 6/1976 | Craig et al. | 48/197 R |
| 3,970,434 | 7/1976 | Gasior et al. | 48/210 |
| 4,026,679 | 5/1977 | Collin | 48/202 |
| 4,146,369 | 3/1979 | Flesch et al. | 48/206 |

FOREIGN PATENT DOCUMENTS

| | | | |
|---|---|---|---|
| 51-95996 | 8/1976 | Japan | 423/415 A |

*Primary Examiner*—Peter F. Kratz

*Attorney, Agent, or Firm*—Burns, Doane, Swecker & Mathis

[57] ABSTRACT

A novel gaseous fuel source and method of production thereof are disclosed. The gaseous fuel is produced by the reaction of carbon and water with the products of the thermal decomposition of calcium carbonate-containing solids such as limestone.

6 Claims, No Drawings

METHOD FOR PRODUCING FUEL GAS FROM LIMESTONE

BACKGROUND OF THE INVENTION

The present invention relates to a novel gaseous energy source derived from limestone and its method of production.

In view of the present worldwide shortage of petroleum-derived fuel, both liquid and gaseous, it has become ecnomical and of some necessity to provide alternative sources of energy. In the past, several types of gaseous fuel have been employed which are derived from different sources.

For example, "water gas" is a well-known gaseous fuel produced by heating carbon and water at relatively high temperatures whereupon a mixture of carbon monoxide and hydrogen is formed as follows:

$$C+H_2O \rightarrow CO+H_2$$

Acetylene has also been produced by the addition of water to calcium carbide at ordinary temperatures as follows:

$$CaC_2+2H_2O \rightarrow Ca(OH)_2+C_2H_2$$

Limestone has also been employed as a raw material in the production of calcium carbide and carbon monoxide as described in French Pat. No. 694,459 (1931) as follows:

$$CaCO_3+4C \rightarrow CaC_2+3CO$$

However, none of the above-described methods of producing a gaseous fuel yield a fuel which is characterized by a high heating value and useful as an industrial fuel in place of more expensive petroleum-derived fuels.

OBJECTS AND SUMMARY OF THE INVENTION

It is therefore an object of the present invention to provide a novel gaseous fuel which may be substituted for petroleum-derived fuels.

It is also an object of the present invention to provide a method of producing a novel gaseous fuel which can be used in industrial applications.

It is yet another object of the present invention to obviate the disadvantages of the prior art as discussed above.

In one aspect of the present invention there is provided a novel gaseous fuel comprising carbon monoxide, at least one gaseous aliphatic hydrocarbon, and hydrogen.

In another aspect of the present invention, there is provided a method for the production of a gaseous fuel composition from a calcium carbonate-containing solid such as limestone comprising:

thermally decomposing said calcium carbonate-containing solid to form calcium oxide and carbon dioxide;

reacting said calcium oxide and carbon dioxide with water and carbon at an elevated temperature to form a gaseous mixture of hydrogen, carbon monoxide, and at least one gaseous aliphatic hydrocarbon.

DETAILED DESCRIPTION OF THE INVENTION

In order to form the novel gaseous fuel of the present invention, marble or other forms of limestone (i.e., $CaCO_3$) is heated in a furnace at a temperature of about 850° C. to decompose the calcium carbonate into calcium oxide (CaO) and carbon dioxide ($CO_2$). Appropriate amounts of carbon and water are then added to the furnace, with the temperature being increased up to about 1,000° C. to form the gaseous fuel mixture of carbon monoxide (CO), hydrogen ($H_2$), low molecular weight aliphatic hydrocarbons (e.g., methane), and calcium carbide.

The reactions which result in the formation of the gaseous fuel proceeds as follows:

Step-wise reactions:

$$CaCO_3 \rightarrow CO_2+CaO$$

$$CO_2+5C+3H_2O \rightarrow 5CO+H_2+CH_4$$

$$CaO+7C+3H_2O \rightarrow 4CO+CH_4+CaC_2$$

Overall Reaction:

$$CaCO_3+12C+6H_2O \rightarrow 9CO+2H_2+2CH_4+CaC_2$$

While the limestone or other source of calcium carbonate is generally initially decomposed at a temperature of about 850° C., temperatures within the range of from about 600° C., to about 900° C. may be employed. In addition, the reaction between the calcium carbonate decomposition products and the carbon and water may take place between about 950° C. and 1300° C., most preferably between about 1,000° C. and 1,100° C. Suitable pressures under which the reaction may occur include atmospheric pressure.

The proportions of carbon and water which are reacted with the calcium carbonate decomposition products may vary within a broad range as long as the reactants are present in the amounts necessary to provide the desired gaseous fuel product. For example, the reactants may generally be employed in weight ratios of $CaCO_3$:C:$H_2O$ about 24:20:15 respectively.

The gaseous fuel which is produced by the novel process of the present invention will generally consist essentially of about 72 to 48 percent by weight of carbon monoxide, 11 to 5.0 percent by weight of hydrogen, and 9.0 to 2.8 percent by weight of gaseous low molecular weight aliphatic hydrocarbons of, for example, 1 to 3 carbon atoms.

The carbon which reacts, together with water, with the calcium carbonate decomposition products may be derived from any suitable conventional source such as industrial coke.

The present invention is to provide a method in the pilot plant by use of a fixed or a fluidized bed.

It is also an object of the present invention to provide a mothod which is working continuously.

What is claimed is:

1. A method for the production of a gaseous fuel composition from a calcium carbonate-containing solid comprising:

thermally decomposing said calcium carbonate-containing solid at a temperature within the range of about 600° C. to about 900° C. to form calcium oxide and carbon dioxide;

reacting said calcium oxide and carbon dioxide with water and carbon at a temperature within the range of about 950° C. to 1300° C. to form a gaseous mixture of hydrogen, carbon monoxide, and at least one gaseous aliphatic hydrocarbon, said calcium carbonate-containing solid, carbon and water being employed in weight ratios suitable to produce a gaseous fuel composition consisting essentially of about 48 to 72 percent by weight of carbon monoxide, about 5 to 11 percent by weight of hydrogen and about 2.8 to 9 percent by weight of gaseous lower molecular weight hydrocarbons of 1 to 3 carbon atoms.

2. The method of claim 1 wherein said calcium carbonate-containing solid comprises limestone.

3. The method of claim 1 wherein said calcium carbonate-containing solid is thermally decomposed at about 850° C.

4. The method of claim 1 wherein said calcium oxide, carbon dioxide, water and carbon are reacted at a temperature in the range of about 1000° C. to about 1100° C.

5. The method of claim 1 wherein said carbon comprises industrial coke.

6. The method of claim 1 wherein said calcium carbonate, carbon and water are employed in weight ratios of about 24:20:15, respectively.

* * * * *